US005468085A

United States Patent [19]

Kline

[11] Patent Number: 5,468,085

[45] Date of Patent: Nov. 21, 1995

[54] USER-CUSTOMIZABLE INDEX DIVIDER SHEET SET AND TABLE OF CONTENTS SHEET ASSEMBLY

[75] Inventor: Brant D. Kline, La Canada, Calif.

[73] Assignee: Avery Dennison Corporation, Pasadena, Calif.

[21] Appl. No.: 349,176

[22] Filed: Dec. 2, 1994

Related U.S. Application Data

[63] Continuation of Ser. No. 332,840, Nov. 1, 1994.

[51] Int. Cl.[6] ..... B42F 13/00

[52] U.S. Cl. ..... 402/79; 281/38; 283/81; 283/36; 283/37; 283/41

[58] Field of Search ..... 281/38; 283/36, 283/37, 39, 41, 66.1, 115; 402/79

[56] References Cited

U.S. PATENT DOCUMENTS

| | | | |
|---|---|---|---|
| 945,765 | 1/1910 | Drake | 283/39 |
| 955,038 | 4/1910 | Bagby | 283/39 |
| 1,069,092 | 7/1913 | Wise | 283/37 |
| 4,978,143 | 12/1990 | Ericson | 283/37 X |
| 4,993,752 | 2/1991 | Juzak . | |
| 5,007,663 | 4/1991 | Moran . | |
| 5,123,676 | 6/1992 | Donnelly et al. | 283/39 X |
| 5,135,261 | 8/1992 | Cusack et al. . | |
| 5,299,879 | 4/1994 | Burrow | 283/36 X |
| 5,316,344 | 5/1994 | Popat et al. . | |

OTHER PUBLICATIONS

*The Original OneStep® Index System;* Cardinal products, St. Louis, Mo.; Copyright 1992.

*Five Easy Ways To Make Avery Ready Index® Dividers;* Avery Dennison Corporation; Copyright 1993, 1994.

*Primary Examiner*—Willmon Fridie, Jr.

*Attorney, Agent, or Firm*—Poms, Smith Lande & Rose

[57] ABSTRACT

First and second index divider sheets, each having outward tabs vertically offset from one another, and a table of contents page are provided, with first and second labels releasably attached to the front of the table of contents page generally adjacent to but spaced from first and second descriptive field areas of that page. The page is passed through a printer or copier and custom indicia are printed in the same operation on the labels and in the field areas. The labels are then removed by the user and attached by their adhesive backings to the respective tabs on one or both sides thereof. The labels before printing are adhered directly to the table of contents page inward of the descriptive field areas, to a removable carrier strip which itself is adhered to the front of the page or to a tear-away strip at the bottom of the page.

26 Claims, 3 Drawing Sheets

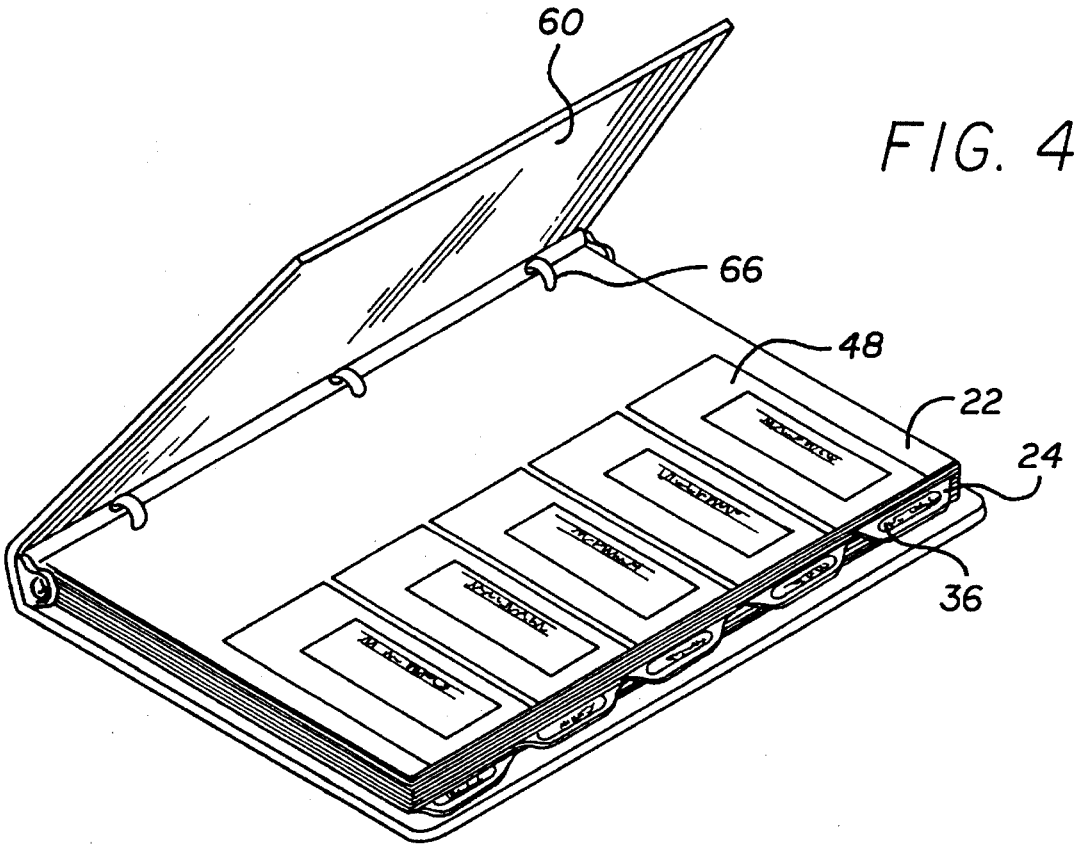
FIG. 4
FIG. 5
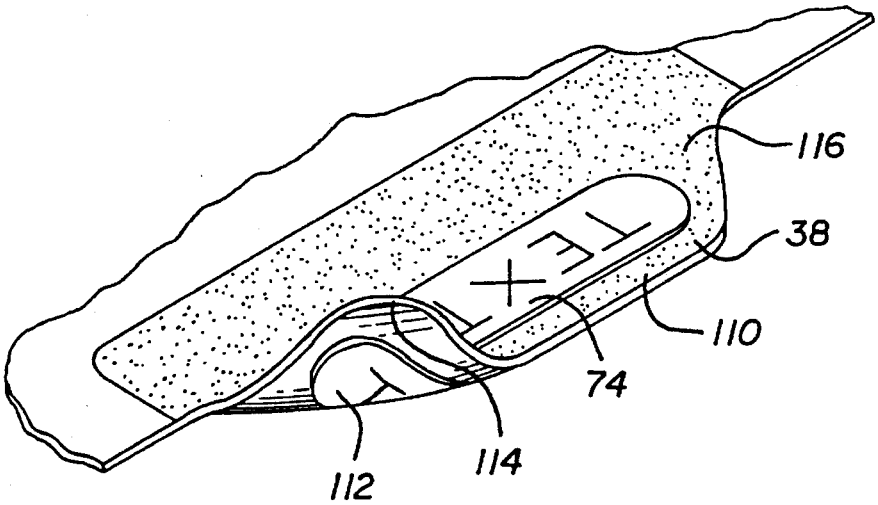

USER-CUSTOMIZABLE INDEX DIVIDER SHEET SET AND TABLE OF CONTENTS SHEET ASSEMBLY

CROSS-REFERENCE TO RELATED APPLICATION

This is a continuing application of copending application Ser. No. 08/332,840 filed Nov. 1, 1994, whose contents are incorporated by reference.

BACKGROUND OF THE INVENTION

The present invention relates to systems for organizing and indexing documents wherein the systems include index divider sets and a table of contents page.

One known prior art system is that of U.S. Pat. No. 5,135,261 (Cusack et al.) which discloses index tab/label assemblies used for notebooks, dividers, files and the like, wherein the user first prints custom indicia on labels supported on a release-treated sheet and then applies the printed labels directly to the tab on a divider or file folder to make a customized index tab. The labels, which are preferably based on a clear plastic film, are coated on one face with materials which enhance their printability in copiers, ink jet or laser printers and, on the opposite face, with pressure sensitive adhesive by which they are attached to the divider or file folder tabs.

U.S. Pat. No. 5,316,344 (Popat et al.) (the '344 patent) discloses a stationery sheet having labels removably attached thereto by pressure sensitive adhesive. The sheet may be sent through laser printer or other printing equipment to print indicia on the sheet and the label. After the sheet exits the printer the labels can be peeled off the sheet and attached to a letter for example. The special adhesive characteristics of the repositionable labels used therein facilitate peeling from the carrier sheet without the need for a release coating which would otherwise mar the appearance of the sheet.

Another commercial product is that available from the present assignee (Avery Dennison Corporation of Pasadena, Calif.) and is marketed as the Ready Index® Dividers. It provides for the quick organization of binders. The Ready Index® table of contents page is simply filled in by the user by means of a printer and a computer running commonly-available word-processing software or by typewriter of by photocopying a previously-printed master copy. The tabs are color and number coded to match the table of contents page. The methods of making these dividers are described in the two-page publication entitled "Five Easy Ways To Make Avery Ready Index® Dividers," copyright 1993, 1994, IFS-0203. (This publication and the two above-mentioned patents are hereby incorporated by reference in their entireties.) This publication discusses that computer programs are available for setting up preset page layouts making it easy to format and print the index dividers. If templates are not included with the software, the publication describes a process of manually creating the templates. It also describes how the system can work with typewriters and copiers if a computer is not available.

An example of another "index" system is the OneStep® Index System available from Cardinal Products of St. Louis, Mo. It is advertised as requiring no tab typing or tab inserting. Rather for one set all that is required is that the section title be typed on the table of contents sheet. According to their advertisement (copyright 1992) it can be used with all copiers and laser printers. The OneStep® system does not provide means for the user to add custom indicia to the tabs of the divider pages. Such custom indicia is generally more descriptive than a scheme of numbers or letters and is, therefore, more useful to the consumer.

No system and method is known, however, for quickly creating a professional quality user-customized system of index dividers complete with a customized table of contents page. Also, this system should minimize the waste of labels and provide a reliable feed and transport through laser and ink jet printers and copiers.

SUMMARY OF THE INVENTION

Directed to achieving these objects, a user-customizable index divider sheet set and table of contents sheet assembly is herein disclosed. This assembly includes a set of index dividers and a partially preprinted table of contents page on which a plurality of adhesively-attached but removable labels are mounted. The user can use readily available word processing software, formatted appropriately to the layout of the table of contents page, to print custom indicia in the description fields on that page and in the same operation on the labels attached thereto. Following printing, the labels are peeled from the table of contents page and attached (by the user) to the tabs of the divider pages. This provides a set of custom-labeled divider pages and a corresponding table of contents page prepared with minimum user effort.

The tabs can be color, shading or pattern matched to the text field highlights of the table of contents page and can contain some or no preprinted indicia. This is most conveniently achieved by printing directly on the tabs or by laminating a colored, shaded or patterned reinforcing film to the tabs. The dividers may be associated with their descriptive text fields on the table of contents page by color, shading or pattern or by their position relative to the top or bottom edge of the page. The labels may be clear or opaque, colored or colorless and may be positioned on one face of the tab, may wrap around to be visible on both sides, or may be created in pairs to provide one label for each side of the tab. The construction of the table of contents page with attached labels may follow the repositionable label technology as described in the previously-mentioned '344 patent or may employ more common pressure-sensitive adhesive technology in conjunction with release treatments.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 4 is a perspective view of the assembly of FIG. 1 shown organized and in place in a folder, binder or the like; and FIG. 5 is an enlarged view of the tab portion of one of the divider sheets of the assembly of FIG. 1 illustrating an embodiment with labels adhered by the user to both tab sides.

DETAILED DESCRIPTION OF THE PREFERRED EMBODIMENTS

Figure 1:
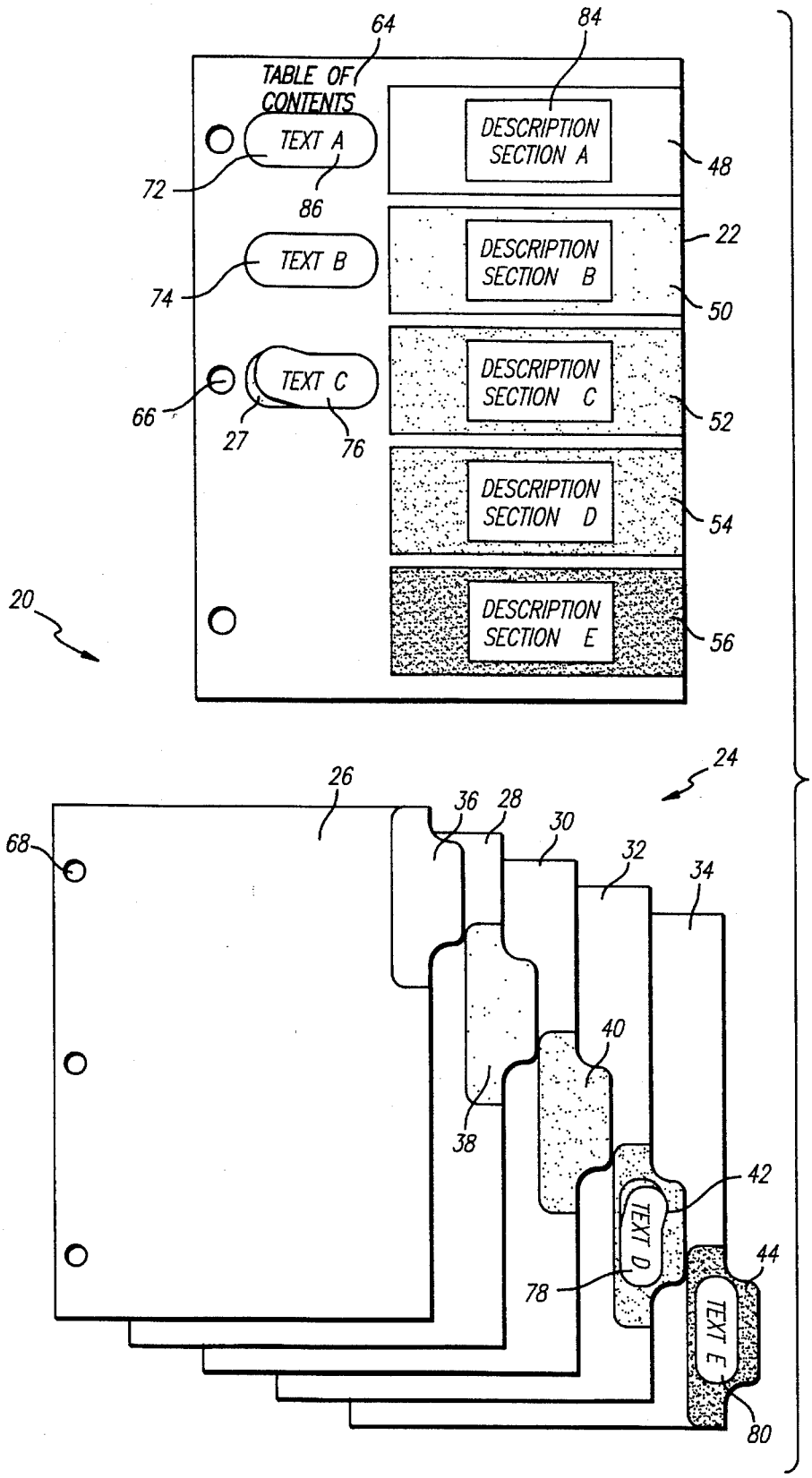
FIG. 1 is a front elevational view of a user-customizable index divider set and table of contents sheet assembly or system of the present invention.

Referring to FIG. 1, an assembly of the present invention is shown generally at 20 and includes a table of contents sheet 22 and a set of divider sheets shown generally at 24. The divider sheets set 24 can include generally any number of divider sheets more than two, and five divider sheets are illustrated in FIG. 1 by reference numerals 26, 28, 30, 32, 34. Each divider sheet includes along its outboard or right edge an outwardly extending tab 36, 38, 40, 42, 44, respectively, which is preferably reinforced by lamination on both sides with a thin plastic film which may be clear or opaque, colored or colorless. On the right or outboard half of the table of contents sheet 22 are five horizontally-oriented descriptive field areas 48, 50, 52, 54, 56. With the table of contents sheet 22 and the set of divider sheets 24 arranged and inserted in a file, binder or the like as shown in FIG. 4 generally at 60, the descriptive field areas 48, 50, 52, 54, 56 are in horizontal alignment with the tabs 36, 38, 40, 42, 44 of its corresponding divider sheet.

For quick reference each of the descriptive field areas 48, 50, 52, 54, 56 can have a different color, pattern, shading or the like, and each of the tabs 36, 38, 40, 42, 44 can have a different color, pattern, shading or the like corresponding to that of the corresponding descriptive field area, as represented by the different stipplings for each as drawn in FIG. 1. This may be achieved by printing, patterning or coloring the reinforcing film or by preprinting the tab portion of the divider page and overlaminating with a clear reinforcing film. When the set of divider sheets 24 are arranged in the binder 60, the tabs 36, 38, 40, 42, 44 of adjacent divider sheets are vertically off-set in a known manner for easy viewing, access and manipulation. If many divider sheets are needed to separate different groupings of papers in the binder 60 and the tab of the first divider sheet is at the top of that sheet and the tab of the last divider sheet is at the bottom of that sheet, then a second set of divider sheets (not shown) and a second table of contents page (not shown) can also be used in the binder 60.

The table of contents sheet 22 will preferably have width and length dimensions of 8½ by eleven inches, a thickness of 0.0045 inch and a weight of twenty-four pounds per 1300 square feet. Each of the divider sheets of set 24 can have width and length dimensions of nine inches by eleven inches, a thickness of 0.008 inch and a weight of a hundred and ten pounds per 3300 square feet. The descriptive field areas 48, 50, 52, 54, 56 are formed on the table of contents sheet 22 according to the process of offset, gravure or other conventional methods of printing. The table of contents sheet 22 preferably will have "Table of Contents" or a similar title 64 (written) prominently thereon. Each of the tabs 36, 38, 40, 42, 44 can have dimensions of one-half inch high by 1¼ to 3¼ inches in length, depending on the number of tabs in the set. And they may contain some or no preprinted indicia. An example of when it is desirable to include preprinted indicia is the use of a company logo or event identifier to be used in multiple sets.

According to a preferred embodiment the tabs 36, 38, 40, 42, 44 are formed on the divider sheet by die-cutting using machinery available from, for example, the Scott Machine Company. The table of contents sheet 22 and each of the divider sheets of set 24 will preferably have three spaced vertically-aligned holes 66, 68, respectively, on their left or inboard side to fit into a conventional three ring binder 60, as depicted in FIG. 4. However, different number and/or placement of the holes (66, 68) or no holes as desired can be used.

In addition to the descriptive field areas 48, 50, 52, 54, 56, on the front of the table of contents sheet 22, repositionable labels 72, 74, 76, 78, 80 are releasably adhered to the front. The labels 72, 74, 76, 78, 80 can have dimensions of one-half inch by one to three inches. The labels are formed of paper or plastic film such as polyethylene terephthalate sold commercially as Mylar™ which may be coated or textured on one surface to enhance printability and coated on the reverse surface thereof with a pressure-sensitive adhesive and may be clear or opaque, colored or colorless.

Using common word processing software, such as Word® available from Microsoft Corporation, WordPerfect® available from Word Perfect, or Ami Pro® available from Lotus Development Corporation, appropriately formatted to the layout of the table of contents sheet 22, the user causes custom indicia 84 to be printed in the descriptive field areas 48, 50, 52, 54, 56 and in the same operation custom indicia 86 to be printed on the labels 72, 74, 76, 78, 80 attached to the front of the table of contents sheet 22. This printing can be in a laser printer, an ink jet printer, a typewriter, a dot matrix printer or a photocopying machine, and a preferred printer (not shown) is the "LaserJet 4 Plus" printer available from Hewlett Packard Corporation. The printing step alternatively can use a photocopy machine and master page prepared using a printer.

The labels 72, 74, 76, 78, 80 are attached to the front of the table of contents sheet 22 with a repositionable pressure sensitive adhesive 90, such as the "Clean Tac" adhesive available from Moore Pressure Sensitive Systems, on the back side of the labels. Another adhesive which can be used is the "P09" adhesive from Avery Dennison Corporation, or generically, a modified acrylic pressure-sensitive type of adhesive used in conjunction with surfaces treated with release agents such as silicones. This adhesive maintains the labels 72, 74, 76, 78, 80 attached to the table of contents sheet 22 during the printing operation, allowing the custom indicia 86 to be printed on the labels while attached to the sheet, and subsequently after printing, allows the labels to be peeled off from the table of contents sheet intact, manually by the user. After having been peeled therefrom they are repositioned by the user and attached to the respective tabs 36, 38, 40, 42, 44 of the divider sheets by the adhesive.

Referring to FIG. 1, the divider sheet 34 shows label 80 having been attached to the tab 44 and divider sheet 32 shows label 78 being attached to the tab 42 thereof. Similarly, the table of contents sheet 22 shows labels 72 and 74 still attached to the page and label 76 in the process of being removed therefrom. In the table of contents sheet 22 of this embodiment the labels 72, 74, 76, 78, 80 are attached by adhesives directly to the front side of the table of contents sheet 22 and on the left or inboard side thereof, vertically arranged.

Figure 2:
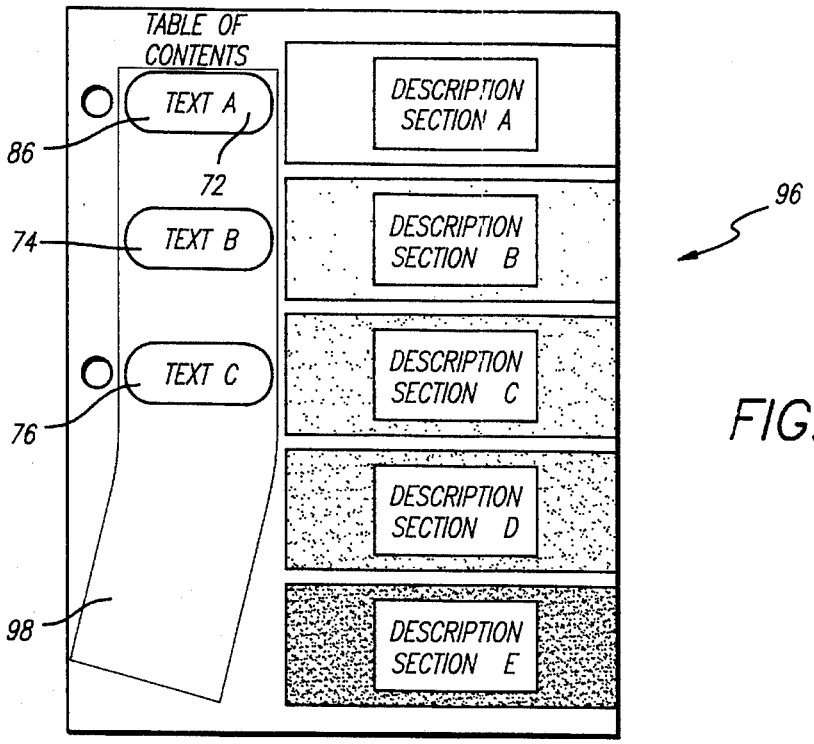
FIG. 2 is an elevational view of an alternative table of contents sheet for the assembly of FIG. 1.

Another embodiment of a table of contents sheet of this invention is shown in FIG. 2 generally at 96. It is seen therein that each of the labels 72, 74, 76, 78, 80 is adhered directly to a carrier strip 98 which in turn is releasably adhered to the front of the table of contents sheet 96 on the left side thereof by a fugitive type of adhesive which leaves a tack-free surface with no visual evidence of having been adhered following separation. The carrier strip 98 can be made of plastic film or coated paper and can have dimensions of up to eleven inches by one to 3½ inches, a thickness of 0.002 inch and a weight of twenty-nine pounds per 3000 square feet.

After the custom indicia 86 have been printed on the labels 72, 74, 76, 78, 80, the labels can be removed from the carrier strip 98 with the carrier strip still attached to the table of contents sheet 96. The preferred method though is to first remove the carrier strip 98; that is, the carrier strip with the custom-indicia printed labels attached thereto is removed from or peeled off of the table of contents sheet 96 and then each of the labels is removed from the strip. This carrier strip 98 embodiment has the advantage that less manipulation is needed of the table of contents sheet while the labels are individually removed. This becomes more important when the number of labels used is great and thus the number of manipulation steps on the table of contents sheet increases to remove the labels. The removal of the labels by careless action may cause smudging, marking or wrinkling on the sheet.

Figure 3:
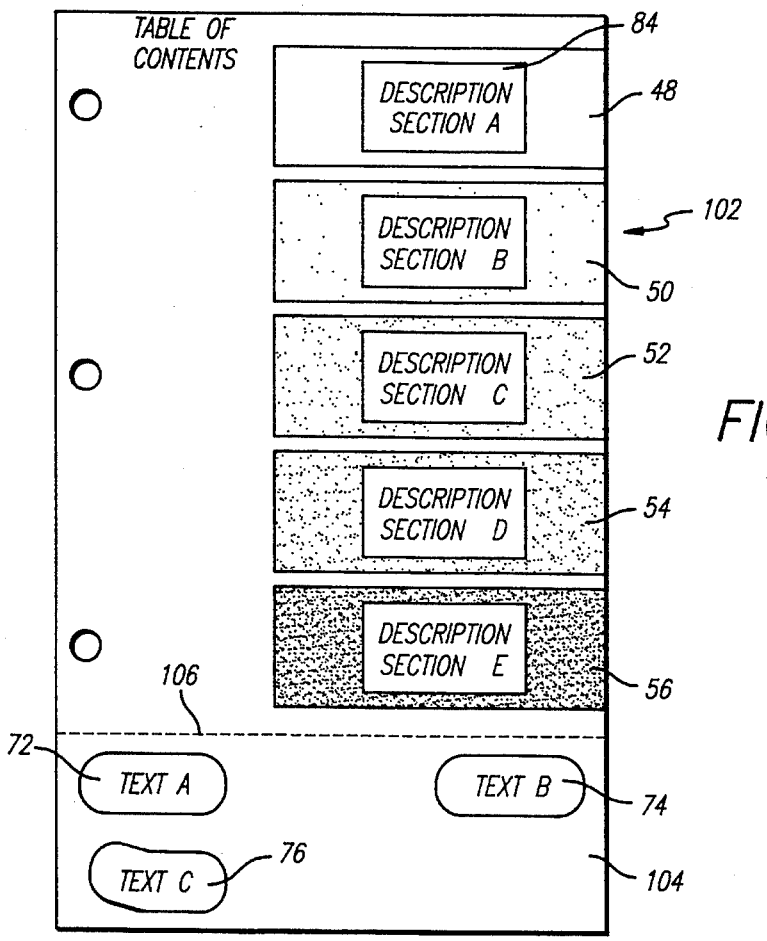
FIG. 3 is an elevational view of another alternative table of contents sheet for the assembly of FIG. 1.

Another embodiment of the table of contents page or sheet of this invention is illustrated in FIG. 3 generally at 102. It is seen therein that the table of contents sheet 102 has the same width dimension as sheets 22 and 96 shown in FIGS. 1 and 2, but a longer length dimension of approximately fourteen inches. At the bottom of the sheet 102 is a tear-off strip 104 having dimensions of 8½ inches by three inches. The tear-strip 104 is of the same weight, thickness, and material as the rest of the table of contents sheet 102 but has been treated on the front surface thereof with release chemicals to facilitate removal of the labels. The tear-off strip 104 is separated therefrom by a horizontal perforation line 106 having perforations and ties of approximately fifty per inch. The perforations have a length dimension relative to the ties of about 0.014 inch to 0.006 inch so that removal of the strip leaves a relatively smooth edge on the bottom of the table of contents sheet. The labels 72, 74, 76, 78, 80 are directly attached to the tear-off strip 104 at the foot end of the sheet 102. Thus, after the custom indicia 84, 86 have been printed in the descriptive field areas 48, 50, 52, 54, 56 and on the labels, the tear-off strip 104 is torn away along the perforation line 106 and each of the labels is sequentially removed and attached to its respective divider sheet tab.

One embodiment of the invention attaches the labels (74, for example) only to the front side 110 of the tab (38, for example). Another preferred embodiment of the invention provides for two labels 74, 112 to be printed in the same printing operation, each removed from the table of contents sheet 22, 96 or 102 and one (74) applied to the front side 110 of the tab and the other 112 to the back side 114 of the tab, as best illustrated in FIG. 5, which also shows reinforced tab area 116. The spines or inboard, binding edges of the divider sheets may also be reinforced. A further embodiment is to provide for a single elongate label (not shown) having first and second halves and custom indicia printed on both of the halves. The indicia printed on both halves of the tabs will preferably be the same. The label after printing is removed from the table of contents sheet (22, 96 or 102) and applied to the tab (38) by wrapping it around from one side of the tab to the other.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A user-customizable index divider sheet set and table of contents sheet assembly, comprising:

first and second index divider sheets, each having along an outer edge thereof outwardly-extending respective first and second index tabs, said first and second tabs being at least partially vertically offset from one another, with said divider sheets aligned;

a table of contents sheet having a front side, and generally on an outer portion of said front side, first and second at least substantially vertically-spaced and visually-different descriptive field areas, said field areas being positioned such that with said divider sheets and said table of contents sheet aligned, said first descriptive field area is horizontally aligned with said first tab and said second descriptive field area is horizontally aligned with said second tab;

a first label attached to said front side of said table of contents sheet, releasable therefrom by a user after printing thereon or in said first descriptive field area and securable by the user to said first tab; and a second label attached to said front side of said table of contents sheet, releasable therefrom by a user after printing thereon or in said second descriptive field area and securable by the user to said second tab.

2. The assembly of claim 1 wherein said first label has a first visual appearance corresponding to that of said first descriptive field area, and said second label has a second visual appearance different from that of the first visual appearance and corresponding to that of said second descriptive field area.

3. The assembly of claim 1 wherein said first label is releasable from said table of contents sheet after printing thereon.

4. The assembly of claim 1 wherein said first and second index divider sheets have reinforced spines and reinforced tab areas.

5. The assembly of claim 1 wherein said first and second labels are clear or colorless.

6. The assembly of claim 1 wherein said first and second labels are color coordinated with respective said first and second descriptive field areas.

7. The assembly of claim 1 wherein said first tab has a first visual appearance corresponding to that of said first descriptive field area and said second tab has a different second visual appearance corresponding to that of said second descriptive field area.

8. The assembly of claim 1 wherein said table of contents sheet includes a region laterally adjacent to said descriptive field areas, and said first and second labels are mounted in said region.

9. The assembly of claim 1 wherein said table of contents sheet has a foot region below said descriptive field areas, and said first and second labels are removably mounted to said foot region.

10. The assembly of claim 9 wherein said table of contents sheet includes a perforation line separating said foot region from the rest of said table of contents sheet.

11. The assembly of claim 1 further comprising a carrier strip removably adhered to said front side, and said first and second labels are removably adhered directly to said carrier strip.

12. The assembly of claim 11 wherein said removable adhering uses a repositionable adhesive.

13. The assembly of claim 11 wherein said removable adhering uses a combination of pressure-sensitive adhesive and release-treated surface.

14. The assembly of claim 11 wherein said descriptive field areas are positioned generally on an outboard portion of said front side and said carrier strip is positioned generally on an inboard portion of said front side.

15. The assembly of claim 11 wherein said carrier strip with said first and second labels thereon is removable from said front side after custom indicia have been printed in a single operation on said first and second labels and in said first and second descriptive field areas.

16. The assembly of claim 1 wherein said first label is securable by the user to both front and back sides of said first tab, wrapping around said first tab between the front and back sides.

17. The assembly of claim 16 wherein printing on said first label is on both left and right halves of said first label such that printed indicia is provided on both front and back sides of said first tab after said first label has been wrapped around and secured to said first tab.

18. A user-customizable index divider sheet set and table of contents sheet assembly, comprising:

a first divider sheet having a first index tab;

a second divider sheet having a second index tab offset from said first index tab;

a table of contents sheet having a front side and vertically offset first and second descriptive field areas on said front side;

wherein when said first and second divider sheets and said table of contents sheet are in an aligned position, said first descriptive field area is horizontally aligned with said first tab and said second descriptive field area is horizontally aligned with said second tab;

first and second labels secured to said front side, wherein custom indicia can be printed on said labels and on said first and second descriptive field areas in a manner such that said first label visually corresponds to said first descriptive field area and said second label visually corresponds to said second descriptive field area;

first adhesive means for adhering said first label with the custom indicia printed thereon to said front side and for allowing a user to remove said first label from said front side after the printing thereon and thereafter adhering said removed first label to said first tab; and second adhesive means for adhering said second label with the custom indicia printed thereon to said front side and for allowing a user to remove said second label from said front side after printing thereon and thereafter adhering said removed second label to said second tab.

19. The assembly of claim 18 wherein said first and second descriptive fields areas, aside from their different locations on said table of contents sheet, are visually different from one another.

20. The assembly of claim 19 wherein said descriptive field areas are differently colored or shaded and said tabs are correspondingly colored or shaded.

21. The assembly of claim 18 wherein said table of contents sheet includes as part of said front side a releasable adhesive carrier strip and said first and second adhesive means releasably adhere said first and second labels directly to said carrier strip.

22. A user-customizable index divider sheet set and table of contents sheet assembly, comprising:

first and second index divider sheets, each having along an outer edge thereof outwardly-extending respective first and second index tabs, said first and second tabs being at least partially vertically offset from one another, with said divider sheets aligned;

a table of contents sheet having a front side, and generally on an outer portion of said front side, first and second at least substantially vertically-spaced descriptive field areas, said descriptive field areas being positioned such that with said divider sheets and said table of contents sheet aligned, said first descriptive field area is horizontally aligned with said first tab and said second descriptive field area is horizontally aligned with said second tab;

a first label attached to said front side of said table of contents sheet, releasable therefrom by a user and then adhesively securable by the user to said first tab;

a second label attached to said front side of said table of contents sheet, releasable therefrom by a user and then adhesively securable by the user to said second tab; and first, second, third and fourth indicia printed in a single pass through a printer of said table of contents sheet with said first and second labels attached thereto and on said first label, said second label, said first descriptive field area and said second descriptive field area, respectively.

23. The assembly of claim 22 wherein said first and third indicia correspond and said second and fourth indicia correspond.

24. The assembly of claim 22 wherein said first label is securable to a front side of said first tab and said second label is securable to a front side of said second tab, and further comprising (a) a third label attached to said front side of said table of contents sheet, releasable therefrom after the printer has printed fifth indicia thereon and then adhesively securable to a back side of said first tab, and (b) a fourth label attached to said front side of said table of contents sheet, releasable therefrom after the printer has printed sixth indicia thereon and then adhesively securable to a back side of said second tab.

25. The assembly of claim 24 wherein said first and fifth indicia are the same, and said second and sixth indicia are the same.

26. The assembly of claim 22 wherein said first and second descriptive field areas are differently colored or shaded, and said first and second tabs are respectively and correspondingly colored or shaded.

* * * * *